United States Patent [19]

Furuhashi et al.

[11] 4,450,819

[45] May 29, 1984

[54] DEVICE FOR ADJUSTING INJECTION TIMING OF A DISTRIBUTION-TYPE FUEL INJECTION PUMP

[75] Inventors: Yasuhiro Furuhashi; Naozi Ishikawa; Shizuo Kawai, all of Kariya, Japan

[73] Assignee: Nippondenso Co., Ltd., Kariya, Japan

[21] Appl. No.: 377,175

[22] Filed: May 11, 1982

[30] Foreign Application Priority Data

May 15, 1981 [JP] Japan ..... 56-69195[U]

[51] Int. Cl.[3] ..... F02M 59/20

[52] U.S. Cl. ..... 123/502; 417/462

[58] Field of Search ..... 123/502, 501; 417/462

[56] References Cited

U.S. PATENT DOCUMENTS

| | | | |
|---|---|---|---|
| 3,771,506 | 11/1973 | Davis | 123/502 |
| 3,943,902 | 3/1976 | Skinner | 123/502 |
| 4,262,645 | 4/1981 | Kobayashi et al. | 123/502 |
| 4,329,961 | 5/1982 | Johnston | 123/502 |
| 4,333,437 | 6/1982 | Lohner et al. | 123/502 |
| 4,355,621 | 10/1982 | Yasuhara | 123/502 |

FOREIGN PATENT DOCUMENTS

| | | | |
|---|---|---|---|
| 55-35123 | 3/1980 | Japan | 123/502 |
| 2047922A | 12/1980 | United Kingdom | 123/502 |
| 2068591A | 8/1981 | United Kingdom | 123/502 |

*Primary Examiner*—Ira S. Lazarus
*Assistant Examiner*—Magdalen Moy
*Attorney, Agent, or Firm*—Cushman, Darby & Cushman

[57] ABSTRACT

The present invention relates to a device for adjusting the injection timing of a distribution-type fuel injection pump for internal combustion engines. In the device of the present invention in which an adjusting piston is moved responsive to the fuel pressure in the high-pressure oil chamber and the resilient force of the timer spring, and the roller ring is rotated following the movement of the adjusting piston, the improvement comprises a cylinder which is provided in addition to a cylinder that accommodates the adjusting piston, and a shaft which slides in the above cylinder separately from the adjusting piston, so that the position of the adjusting piston can be adjusted by the shaft. The device employs sliding portions that do not require strict machining precision. Further, when the fuel injection pump is to be mounted on the engine, the initial timing can be easily adjusted through manipulation effected from the outer side of the fuel injection pump.

3 Claims, 3 Drawing Figures

DEVICE FOR ADJUSTING INJECTION TIMING OF A DISTRIBUTION-TYPE FUEL INJECTION PUMP

BACKGROUND OF THE INVENTION

1. Field of the Invention

The present invention relates to a device for adjusting the injection timing of a fuel injection pump, and more specifically to a device for adjusting the injection timing of a distribution-type fuel injection pump used for internal combustion engines.

2. Description of the Prior Art

According to a conventional device for adjusting injection timing of fuel injection pumps of this type, a roller ring is rotatably supported in a circular cavity that is formed in a casing of the fuel injection pump, rollers are rotatably supported by the roller ring via a pin so as to drive, in a contacting manner, a cam plate that is connected to the piston of a distribution pump in the fuel injection pump, a shaft which is supported by the roller ring and which outwardly protrudes in the radial direction is coupled to an adjusting piston which is accommodated in a housing contiguous with the circular cavity, a cylinder is disposed between the adjusting piston and the housing, a timer spring is provided between the cylinder and the adjusting piston to impart a resilient force to the adjusting piston, a protrusion having a threaded portion is formed at the tip of the cylinder and is allowed to protrude beyond the housing, an adjusting nut is screwed onto the threaded portion from the outer side of the housing, and the roller ring is moved by operating the adjusting nut to adjust the start of the static injection without the need of changing the stroke of the adjusting piston, thereby changing the injection timing.

In the thus constructed device for adjusting the injection timing in which the cylinder is disposed between the housing and the adjusting piston, and slides relative to the housing, the inner peripheral surface of the cylinder must be so machined that the adjusting piston slides therein maintaining oil-tightness and the outer periphery of the cylinder must also be so machined that it slides relative to the housing maintaining oil-tightness. Therefore, very strict machining precision and quality control are required in regard to the degree of the circle and surface coarseness on both the inner and outer peripheries of the cylinder.

SUMMARY OF THE INVENTION

In order to eliminate the above-mentioned difficulty, according to the present invention, a slide shaft or rod is provided in the cylinder in the housing separately from the adjusting piston, such that the position of the adjusting piston can be adjusted by sliding the shaft. In a device for adjusting the injection timing of a distribution-type fuel injection pump, in which the adjusting piston is moved responsive to the fuel pressure in a high-pressure oil chamber and the force of the timer spring, and the roller ring is rotated following the adjusting piston, of the present invention, provision is made of a cylinder, in addition to a cylinder which accommodates the adjusting piston, a shaft is slidably inserted in the cylinder, both ends of the shaft are provided with end members, the timer spring is inserted between one end member and an end of the adjusting piston such that the other end of the adjusting piston comes into contact with the other end of the shaft being urged by the timer spring, and an end of an adjusting screw, which is screwed from the outer side of the housing is brought into contact with the end member of the shaft. When the fuel injection pump is to be mounted on an engine, therefore, the initial timing of the fuel injection pump for the engine can be easily set and adjusted by manipulating from the external side of the fuel injection pump, without changing the moving amount of the adjusting piston or without changing the mounting load of the timer spring. Further, sliding portions of the shaft and the cylinder for adjusting the initial timing need to be machined to a degree equal to that of the oil-tight sliding portions between the adjusting piston and the cylinder, which is usually not difficult. Therefore, difficulty encountered in the conventional device is not involved in controlling the machining precision and, hence, a device for adjusting the injection timing of a fuel injection pump can be obtained through an easy machining operation.

The object of the present invention is to provide a device for adjusting the injection timing of a fuel injection pump, the sliding portions of the device being obtained through an easy machining operation.

Another object of the present invention is to provide device for adjusting the injection timing of a distribution-type fuel injection pump for use with internal combustion engines, the device being so constructed that, when the fuel injection pump is mounted on the engine, the initial timing of the fuel injection pump for the engine can be easily adjusted by manipulation, from the outer side of the full injection pump, without changing the moving amount of the adjusting piston or without changing the mounting load of the timer spring.

Features of the present invention will become more apparent from the following preferred embodiment, taken in conjunction with the accompanying drawings.

DETAILED DESCRIPTION OF THE INVENTION

Prior to describing the present invention, a conventional device for adjusting the injection timing in a distribution-type fuel injection pump will be illustrated below concretely.

Figure 1:
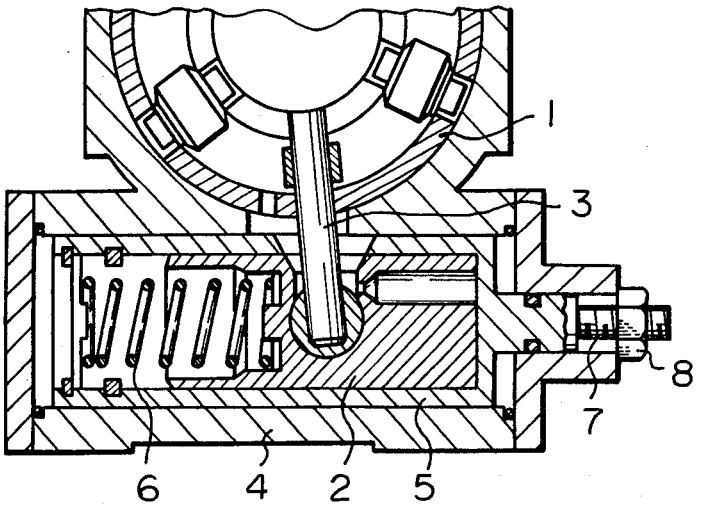
Fig. 1 PRIOR ART
FIG. 1 is a sectional view of a conventional device for adjusting the injection timing in a distribution-type fuel injection pump.

In the conventional device of this type, as shown in FIG. 1, a roller ring 1 and an adjusting piston 2 are coupled together through a shaft 3, a cylinder 5 is disposed between the adjusting piston 2 and a housing 4, a timer spring 6 is provided between the cylinder 5 and the adjusting piston 2 to impart resilient force to the adjusting piston 2, a protrusion having a threaded portion 7 is formed at the tip of the cylinder 5 and is allowed to protrude beyond the housing 4, an adjusting nut 8 is screwed onto the threaded portion 7 from the outer side of the housing, and the roller ring 1 is moved by manipulating the adjusting nut 8 to adjust the start of static injection and to change the injection timing without the need of changing the stroke.

In the thus constructed device for adjusting the injection timing, in which the cylinder 5 is disposed between the housing 4 and the adjusting piston 2, and slides relative to the housing 4, the inner peripheral surface of the cylinder must be so machined that the adjusting piston 2 slides therein maintaining oil-tightness and the outer peripheral surface of the cylinder 5 must also be so machined that it slides relative to the housing 4 maintaining oil-tightness. Therefore, very strict machining precision and quality control are required in regard to the degree of the circle and surface coarseness on both the inner and outer peripheries of the cylinder.

Setup of the present invention will be mentioned below with reference to a preferred embodiment shown in FIG. 2.

Figure 2:
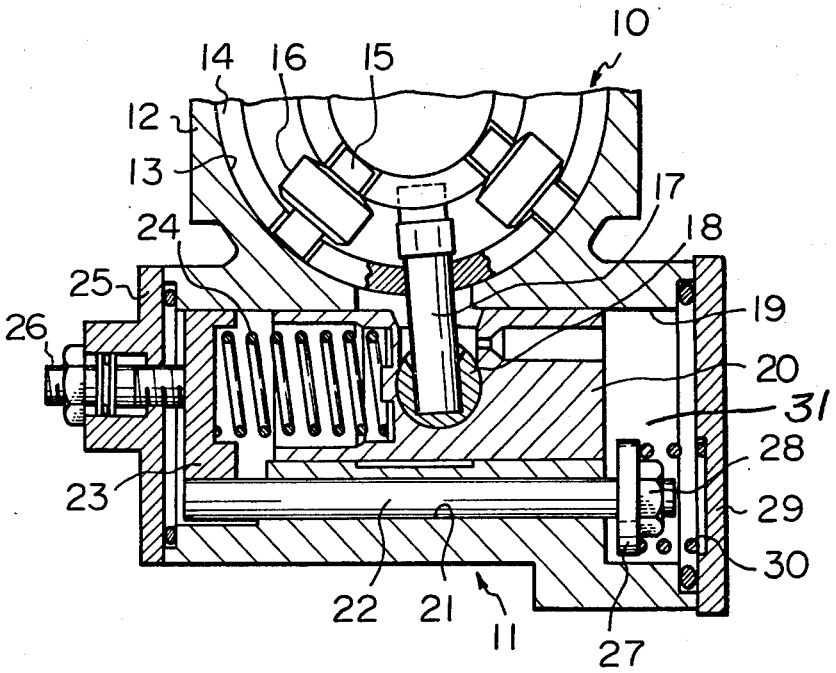
FIG. 2 is a sectional view of a device for adjusting the injection timing in a distribution-type fuel injection pump according to a preferred embodiment of the present invention.

The device for adjusting the injection timing of a fuel injection pump of the present invention has, as shown in FIG. 2, a cam-drive means 10 for driving a cam plate (not shown) that actuates a piston (not shown) of a distribution pump in the fuel injection pump, and an adjusting piston means 11 which actuates the cam-drive means 10.

The cam-drive means 10 has a roller ring 14 that is rotatably fitted in a circular cavity 13 formed in a housing 12 of the fuel injection pump, rollers 16 rotatably supported by the roller ring 14 via pin 15, and a shaft 17 which is supported by the roller ring 14 and which outwardly protrudes in the radial direction. A spherical slide piece 18 is attached to the protruded end of the shaft 17. The rollers 16 come into contact with a cam plate (not shown) connected to the piston of a distribution pump of the fuel injection pump to drive it.

The adjusting piston means 11 has an adjusting piston 20 which reciprocally moves in a cylinder 19 that is formed in the housing 12 contiguous with the cavity 13 of the cam-drive means 10 and that has an axis nearly at right angles with the axis of the cavity 13. The adjusting piston 20 moves in the axial direction in the cylinder responsive to the change in the fuel pressure. The slide piece 18 at the end of the shaft 17 is fitted to a central portion of the adjusting piston 20, and the roller ring 14 rotates accompanying the motion of the adjusting piston 20 in the axial direction.

In the housing 12 is further formed a cylinder 21 having an axis which is parallel with the axis of the cylinder 19. A shaft or rod 22 is provided to slide in the cylinder 21 in the axial direction thereof. A flange 23 is secured by welding or the like to one end of the shaft 22, and a timer spring 24 is inserted between the end of the adjusting piston 20 and the flange 23. A tip of an adjusting screw 26 is in contact with the flange 23 on the side opposite to the side of the timer spring, the adjusting screw 26 being capable of moving in the axial direction of the cylinder 19 penetrating through a cover 25 which covers the end of the cylinder 19. A stopper 27 is fitted to the other end of the shaft 22 up to a predetermined position, and is fastened by nut 28. A spring 30 is inserted between the stopper 27 and a cover 29.

Within the cylinder 19, a pressure chamber 31 is formed, into which a pressurized fluid is introduced through an inlet port (not shown) formed in the housing 12.

The function of the present invention will be mentioned below. In the thus constructed device for adjusting the injection timing, when the fuel pressure in the pressure chamber 31 increases in response to the rise in the running speed of the engine, the adjusting piston 20 is urged to move leftwards in FIG. 2 against the force of the timer spring 24. The motion of the adjusting piston 20 causes the roller ring 14 to turn clockwise via the shaft 17, whereby positions of the rollers 16 are moved to advance the timing for fuel injection. When the fuel pressure decreases, the adjusting piston 20 moves rightwards due to the force of the timer spring 24, whereby the roller ring 14 turns counterclockwise to adjust again the positions of the rollers 16. Under ordinary operation conditions, as mentioned above, positions of the rollers 16 are automatically adjusted responsive to the change in the fuel pressure. The adjusting piston 20 moves from a position at which one end of the adjusting piston 20 comes into contact with the stopper 27 to a position at which the other end of the adjusting piston 20 comes into contact with the flange 23. The amount of movement is determined beforehand depending upon the the angle-advancing characteristics required for the engine.

When it is desired to adjust the initial timing of the fuel injection pump which is mounted on an engine, the adjusting screw 26 is rotated in a predetermined direction to move the flange 23, shaft 22 and stopper 27 as a unitary structure. When the initial timing is to be set, the adjusting piston 20 is in contact with the stopper 27 being urged by the timer spring 24. By turning the adjusting screw 26 to adjust the position of the stopper 27 via the flange 23 and the shaft 22, the position of the initial timing of the fuel injection pump can be adjusted relative to the engine. The flange 23 has been urged toward a direction to press the adjusting screw 26 by the spring 30 via the shaft 22 and stopper 27.

In FIG. 2, when the adjusting screw 26 is screwed rightwards, the stopper 27 and the adjusting piston 20, in contact with the stopper 27, are allowed to move rightwards, and the roller ring 14 turns in the counterclockwise direction via the shaft 17. In this case, positions of the rollers 16 are so adjusted that the timing for fuel injection is delayed.

When the adjusting screw 16 is so turned as to move leftwards, the timing for fuel injection is advanced.

Figure 3:
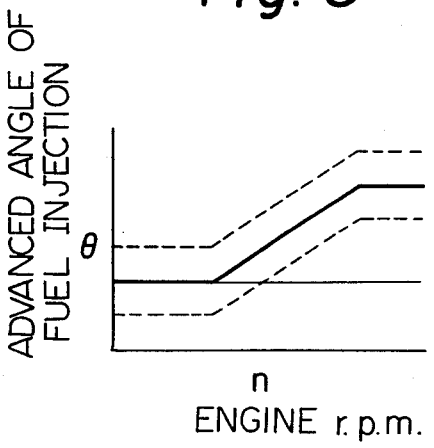
FIG. 3 is a diagram illustrating angle-advancing characteristics of the device for adjusting the injection timing in the distribution-type fuel injection pump according to the present invention.

FIG. 3 illustrates angle-advancing characteristics which represent a relation between the angle $\theta$ for adjusting the injection timing and the running speed n of the engine. A solid line represents characteristics when the device is just mounted on the engine, and broken lines represent characteristics accomplished by the device of the present invention. The cylinder 21 and the shaft 22 may be provided in a plurality of numbers.

It will be comprehended from the foregoing description that the device of the present invention is free of the difficulty inherent in the conventional devices of this type.

We claim:

1. A device adjusting the injection timing of a distribution-type fuel injection pump having a housing comprising:

a roller ring rotatably supported in a circular cavity that is formed in the housing of said fuel injection pump;

rollers which are rotatably supported by said roller ring via pins;

a shaft which is supported by said roller ring and which protrudes outwardly radially of said roller ring;

an adjusting piston which is coupled to said shaft and which slides in a first cylinder being urged by the fuel pressure; and a timer spring which urges said adjusting piston so that said adjusting piston is moved responsive to the fuel pressure and the resilient force of said timer spring, and said roller ring is turned following movement of said adjusting piston, the improvement comprising:

a second cylinder parallel to and offset axially from said first cylinder, a rod slidable in said second cylinder, end members on both ends of said rod, said timer spring being inserted between one of said end members and an end of said adjusting piston such that the other end of said adjusting piston comes into contact with the other of said end members, and an adjusting screw, which is screwed from the outer side of said housing, engaged with said one end member.

2. A device for adjusting the injection timing of a distribution-type fuel injection pump comprising;

a housing;

a roller ring rotatably disposed in said housing for adjusting the injection timing of fuel when rotated with respect to said housing;

a first cylinder formed in said housing;

first and second covers for the ends of said first cylinder;

an adjusting piston slidably disposed in said first cylinder;

a shaft operatively connecting said adjusting piston with said roller ring;

a flange movably disposed in said first cylinder between said first cover and one end of said adjusting piston;

a second cylinder formed in said housing parallel to said first cylinder;

a rod slidably disposed in said second cylinder, one end of said rod being fixed to said flange;

a timer spring disposed between said adjusting piston and said flange for urging said adjusting piston in a direction away from said flange;

a fluid pressure chamber formed in said first cylinder between the other end of said adjusting piston and said second cover; and a stopper on the other end of said rod and being disposed in said fluid pressure chamber and in contact with said other end of said adjusting piston when the pressure in said fluid pressure chamber is smaller than the urging force of said timer spring.

3. A device for adjusting the injection timing of a distribution-type fuel injection pump according to claim 2, further comprising:

an adjusting screw extending through said first cover, the tip of said screw being in contact with said flange; and a compression spring disposed in said fluid pressure chamber and urging said rod and said flange toward said adjusting screw.

* * * * *